US006504560B2

(12) United States Patent
Sogabe et al.

(10) Patent No.: US 6,504,560 B2
(45) Date of Patent: Jan. 7, 2003

(54) METHOD FOR FORMING IMAGE BY THERMAL TRANSFER

(75) Inventors: Jun Sogabe, Osaka (JP); Tetuo Hoshino, Osaka (JP); Yasutoshi Inoue, Tokyo-to (JP)

(73) Assignees: Fujicopian Co., Ltd., Osaka (JP); Alps Electric Co., Ltd., Tokyo-to (JP)

( * ) Notice: Subject to any disclaimer, the term of this patent is extended or adjusted under 35 U.S.C. 154(b) by 0 days.

(21) Appl. No.: 09/895,080

(22) Filed: Jun. 29, 2001

(65) Prior Publication Data

US 2002/0109769 A1 Aug. 15, 2002

(30) Foreign Application Priority Data

Jun. 29, 2000 (JP) ..... 2000-197024

(51) Int. Cl.[7] ..... B41M 5/26; B41M 5/34; B41J 2/525

(52) U.S. Cl. ..... 347/172

(58) Field of Search ..... 347/172, 174, 347/176; 400/120.02, 120.04

(56) References Cited

U.S. PATENT DOCUMENTS 5,726,698 A * 3/1998 Shinozaki et al. ..... 347/172

* cited by examiner

*Primary Examiner*—Huan Tran
(74) *Attorney, Agent, or Firm*—Fish & Neave

(57) ABSTRACT

A method for forming an image by thermal transfer: comprising forming a multi-color image using two chromatic color thermal transfer ink ribbons A and B, the thermal transfer ink ribbons A and B having respective chromatic colors which satisfy the following relations:

$$Y_A+Y_B \geqq 1.0$$

$$M_A+M_B \geqq 1.0$$

$$C_A+C_B \geqq 1.0$$

wherein $Y_A$, $M_A$, and $C_A$ are defined respectively as values obtained by color separation of the optical reflection density of the thermal transfer ink ribbon A into Y, M, and C components, and $Y_B$, $M_B$, and $C_B$ are defined respectively as values obtained by color separation of the optical reflection density of the thermal transfer ink ribbon B into Y, M, and C components.

2 Claims, No Drawings

METHOD FOR FORMING IMAGE BY THERMAL TRANSFER

BACKGROUND OF THE INVENTION

The present invention relates to a method for forming a multi-color image by selectively and thermally transferring two chromatic color heat sensitive ink layers onto an image receptor by means of a thermal transfer printer such as a printer, with a thermal head.

Conventionally, full-color expression by thermal transfer was performed by utilizing colors obtained by a subtractive color mixing wherein three colors, cyan (C), magenta (M) and yellow (Y), which are process colors, or four colors, further including black (BK), were superimposed.

Although a high-quality color image with colors close to natural colors can be obtained, this method has a disadvantage in that the image data for outputting the image tends to become immense. Further, upon outputting the image, it is necessary to superimpose the colors three or four times, and hence, the method consumes time and ink ribbons.

Depending on the type of image, some do not need to have a high-quality and wide color reproductivity, like the above-described image. For example, in the case for instruction manuals for appliances, diagrammatic figures of appliances, and the like, it is preferable to obtain an image at low cost and high speed rather than with color reproductivity.

To address the above-described requirements, the present inventors tried to form a multi-color image by thermal transfer using only two color ink ribbons. However, the color expression ranges were narrow. Also, a natural color expression could not be obtained even if two conventionally used process colors selected from cyan (C), magenta (M), yellow (Y), and black (BK) were used in combination, and the combinations of these two colors were found practically useless although high speed could be achieved. Further, it was especially difficult to obtain excellent shadow parts (black parts) by the foregoing two color combinations, resulting in a failure to obtain a sharp and high-quality image.

In view of the foregoing, it is an object of the present invention to provide a thermal transfer image formation method capable of easily performing pseudo-full-color expression using two color ink ribbons while minimizing cost and time.

This and other objects of the present invention will become apparent from the description hereinafter.

SUMMARY OF THE INVENTION

The present invention provides a method for forming an image by thermal transfer:

comprising forming a multi-color image using two chromatic color thermal transfer ink ribbons A and B, the thermal transfer ink ribbons A and B having respective chromatic colors which satisfy the following relations:

$$Y_A+Y_B \geqq 1.0$$

$$M_A+M_B \geqq 1.0$$

$$C_A+C_B \geqq 1.0$$

wherein $Y_A$, $M_A$, and $C_A$ are defined respectively as values obtained by color separation of the optical reflection density of the thermal transfer ink ribbon A into Y, M, and C components, and $Y_B$, $M_B$, and $C_B$ are defined respectively as values obtained by color separation of the optical reflection density of the thermal transfer ink ribbon B into Y, M, and C components.

DETAILED DESCRIPTION

The present invention provides a method for performing a multi-color expression using two chromatic color thermal transfer ink ribbons, characterized by a method for forming an image by thermal transfer using two color thermal transfer ink ribbons A and B having respective chromatic colors in which the sum of the optical reflection density for each color component obtained by color-separating the reflection density of the color of the ink ribbon A into Y, M, C components and the optical reflection density for each color component obtained by color-separating the reflection density of the color of the ink ribbon B into Y, M, C components is 1.0 or higher for every color component, as described above.

By superimposing two colors satisfying the above described specified relations, all of Y, M, C components, which are three primary colors, can exist in the resultant image. As a result, a natural color expression with a rich hue is possible. Further, since the minimum value of the sum of the respective optical reflection density values of the ink ribbons A and B for each color component is 1.0 or higher, shadow parts (black parts) expressed by superimposing two colors are made clear and sharp images can be provided. More preferably, the minimum value of the sum of the respective optical reflection density values of the ink ribbons A and B for each color component is 1.5 or higher. That is, it is more preferable to use thermal transfer ink ribbons having the respective optical reflection densities satisfying the following relations:

$$Y_A+Y_B \geqq 1.5$$

$$M_A+M_B \geqq 1.5$$

$$C_A+C_B \geqq 1.5$$

Further, the chromatic color of one ribbon A out of the thermal transfer ink ribbons used in the present invention preferably has a density value for at least one color component, among the optical reflection density values ($Y_A$, $M_A$, and $C_A$) for components Y, M, and C obtained by separating the optical reflection density of the ribbon A into the respective color components, of 0.9 or lower, more preferably 0.5 or lower. Similarly, the chromatic color of the other ribbon B out of the thermal transfer ink ribbons used in the present invention preferably has a density value for at least one color component, among the optical reflection density values ($Y_B$, $M_B$, and $C_B$) for components Y, M, and C obtained by separating the optical reflection density of the ribbon B into the respective color components, of 0.9 or lower, more preferably 0.5 or lower. If the density value of at least one color component among the optical reflection density values ($Y_A$, $M_A$, and $C_A$) or ($Y_B$, $M_B$, and $C_B$) obtained by separating the reflection density of each of the thermal transfer ink ribbons A and B into the respective color components exceeds the foregoing range, the resultant images are inferior in color clearness and expression as chromatic colors tends to be deteriorated.

In the present invention, the optical reflection density values ($Y_A$, $M_A$, and $C_A$) and ($Y_B$, $M_B$, and $C_B$) of the respective components Y, M, and C for two chromatic color thermal transfer ink ribbons A, B are measured by employing Gratag Macbeth RD-918 (produced by Macbeth Co.). The filters used have the spectral sensitivity characteristics of ISO status I and have peak wave wavelength of 432 nm for blue, 536 nm for green, and 624 nm for red, respectively. The optical reflection density measurement was directly carried out on the surface of the colored ink layers of the thermal transfer ink ribbons.

As the two chromatic color thermal transfer ink ribbons A, B used in the method of the present invention, any can be employed without particular limitation on other elements as long as they satisfy the above described optical reflection density conditions.

For example, a variety of materials used as supports for conventional thermal transfer ink ribbons can be employed as a support for the above described ink ribbons. However, from the aspects of heat resistance, heat conduction and cost, polyester films with a thickness of 1 to 6 $\mu$m are preferable and a poly (ethylene terephthalate) film (PET film) is especially preferable. It is desirable to provide a heat resistant lubricating layer on the rear side (the side with which a thermal head or the like is brought into sliding contact) of the support.

For the ink layer of the above described ink ribbons, a variety of materials that are used in conventionally known thermally transferable inks can be used, including those which comprise a binder, composed mainly of a wax material and/or a thermoplastic resin, and a coloring agent dispersed in the binder.

Those usable as the above described wax materials are, for example, paraffin wax, microcrystalline wax, Fischer-Tropsch wax, polyethylene waxes with various molecular weights and their modified waxes, carnauba wax, and the like. These wax materials can be used alone or as a mixture of two or more.

Those usable as the above described thermoplastic resins are, for example, one or more polymers selected from olefin copolymers such as ethylene/vinyl acetate copolymer, polyamide resin, polyester resin, butyral resin; methacrylic acid esters such as methyl methacrylate, ethyl methacrylate, butyl methacrylate, hydroxyethyl methacrylate and the like, and methacrylic acid, acrylic acid esters such as methyl acrylate, ethyl acrylate, butyl acrylate and the like, and acrylic acid; natural rubber, petroleum resin, rosin resin, styrene resin, and the like. These resin materials may be used alone or as a mixture of two or more of them.

Those usable as the above described coloring agents are a variety of known pigments and dyes. Examples are azo type, phthalocyanine type, quinacridone type, thioindigo type, anthraquinone type, and isoindoline type pigments. These coloring agents may be used alone or as a mixture of two or more in combination.

Further, in order to obtain a clear color, the content of a coloring agent per unit area for an ink layer is preferably 0.3 to 1.5 g/m$^2$. If the content per unit area for the ink layer is less than 0.3 g/m$^2$, the optical reflection density becomes insufficient and if higher than 1.5 g/m$^2$, the color clearness tends to deteriorate.

Further, in order to enhance a deep color as a whole, it may be necessary to add a pigment, such as a black pigment, e.g. carbon black, or a pigment with high density, such as phthalocyanine type pigment, or a variety of fillers with high light-shielding property, such as titanium oxide, aluminum powder or the like to a primary pigment (pigment determining the hue of an ink) to the extent that they do not deteriorate the subtractive color mixing of the two colors. The amount of such an auxiliary component is preferably 0.1 to 20% by weight, more preferably 0.1 to 10% by weight to the primary pigment. If the amount of the auxiliary component is less than the foregoing ranges, it is difficult to achieve a deep color and if the amount is higher than the foregoing ranges, color cleanness tends to deteriorate.

In order to control the adhesion property of the surface of an ink layer, a surface modifying agent, such as a lubricant or a variety of fillers, may be added.

The ink layer is preferably thin from the viewpoint of the image reproductivity and the thickness thereof is preferably 0.2 to 3.0 $\mu$m.

In order to improve the adhesion property of the surface of the ink layer, an adhesive layer composed mainly of a thermoplastic resin may be provided on the ink layer. As the thermoplastic resins, those exemplified for the ink layer may be used.

Further, in order to improve the releasability of the ink layer from the support, it is preferable to provide a thermally fusible release layer between the support and the ink layer. The release layer is composed mainly of a wax material and optionally a thermoplastic resin. As the wax materials, those exemplified for the ink layer may be used. Examples of the thermoplastic resins are olefin copolymers such as ethylene/vinyl acetate copolymer, polyamide resin, polyester resin, natural rubber, petroleum resin, rosin resin, styrene resin, and the like. The thickness of the release layer is preferably within a range of 0.1 to 2.0 $\mu$m in terms of thermal transferability. If the thickness of the release layer is smaller than the foregoing range, the effect of improving the releasability becomes insufficient and if greater than the foregoing range, too much heat is needed to melt the release layer and the transferability tends to deteriorate.

The image formation method of the present invention using two chromatic color ink ribbons can be carried out as follows: An original image was image-processed by color-separation into three color components: red, green, and blue. Two components having higher density values are selected from among the optical reflection density values obtained by color separation of the optical reflection density of each ink ribbon into Y component, M component, and C component. The two selected components and the color separation data of the image to be employed for printing are correlated as shown in Table 1. The color separation data of the image (one among red, green, and blue) to be employed for printing are determined for each ink ribbon using the correlation shown in Table 1. One color separation data of the image and one ink ribbon are used to form an image on a receptor by thermal transfer printing and then the other color separation data of the image and another other ink ribbon are used to form an image on the former image. Two color separation data of the image to be employed for image formation can be determined depending upon the type of colors of the original image, the use or purpose of the image to be formed, and the like.

TABLE 1

| Two components with higher values selected among optical reflection density values obtained by separation of optical reflection density of each ink ribbon into Y component, M component, and C component | Color separation data of image to be used for printing |
|---|---|
| Y component, M component | Red |
| M component, C component | Blue |
| C component, Y component | Green |

The present invention will be described in detail by way of Examples. It is to be understood that the present invention is not limited to the Examples, and that various changes and modifications may be made in the present invention without departing from the spirit and scope thereof.

Manufacture of Ink Ribbon 1

A PET film with 2.5 μm thickness and having a 0.2 μm-thick silicone resin-based heat resistant lubricating layer on the rear side was used as a support. The following coating liquid for a release layer was applied onto the front side of the support and dried to form a 0.7 μm-thick release layer.

Coating liquid for release layer

| Component | Parts by weight |
|---|---|
| Paraffin wax (melting point: 75° C.) | 7.0 |
| Candelilla wax (melting point: 70° C.) | 3.0 |
| Toluene | 90.0 |
| Total | 100.0 |

The following coating liquid for an ink layer was applied onto the foregoing release layer and dried to form a 1.5 μm-thick ink layer, yielding ink ribbon 1.

Coating liquid for ink layer

| Component | Parts by weight |
|---|---|
| Ethylene/vinyl acetate copolymer*[1] | 5.0 |
| Terpene phenol resin (melting point: 120° C.) | 2.0 |
| Phthalocyanine Green | 2.5 |
| Disazo Yellow | 0.3 |
| Carbon black | 0.2 |
| Dispersant | 0.1 |
| Toluene | 40.0 |
| Total | 50.1 |

*[1]vinyl acetate content: 28% by weight; melt flow rate: 150 (hereinafter the same)

Manufacture of Ink Ribbon 2

Ink ribbon 2 was obtained in the same manner as that for ink ribbon 1 except the following coating liquid was used to form a 1.5 μm-thick ink layer.

Coating liquid for ink layer

| Component | Parts by weight |
|---|---|
| Ethylene/vinyl acetate copolymer | 5.0 |
| Terpene phenol resin (melting point: 120° C.) | 2.0 |
| Indanthrene Blue | 2.5 |
| Phthalocyanine Blue | 0.5 |
| Carbon black | 0.2 |
| Dispersant | 0.1 |
| Toluene | 40.0 |
| Total | 50.3 |

Manufacture of Ink Ribbon 3

Ink ribbon 3 was obtained in the same manner as that for ink ribbon 1 except the following coating liquid was used to form a 1.5 μm-thick ink layer.

Coating liquid for ink layer

| Component | Parts by weight |
|---|---|
| Ethylene/vinyl acetate copolymer | 5.0 |
| Terpene phenol resin (melting point: 120° C.) | 2.0 |
| Anthraquinonyl Red | 3.0 |
| Carbon black | 0.2 |
| Dispersant | 0.1 |
| Toluene | 40.0 |
| Total | 50.3 |

Manufacture of Ink Ribbon 4

Ink ribbon 4 was obtained in the same manner as that for ink ribbon 1 except the following coating liquid was used to form a 1.5 μm-thick ink layer.

Coating solution for ink layer

| Component | Parts by weight |
|---|---|
| Ethylene/vinyl acetate copolymer | 5.0 |
| Terpene phenol resin (melting point: 120° C.) | 2.0 |
| Disazo Yellow | 3.0 |
| Dispersant | 0.3 |
| Toluene | 40.0 |
| Total | 50.3 |

Manufacture of Ink Ribbon 5

Ink ribbon 5 was obtained in the same manner as that for ink ribbon 1 except the following coating liquid was used to form a 1.5 μm-thick ink layer.

Coating liquid for ink layer

| Component | Parts by weight |
|---|---|
| Ethylene/vinyl acetate copolymer | 5.0 |
| Terpene phenol resin (melting point: 120° C.) | 2.0 |
| Carmine 6 B | 3.0 |
| Dispersant | 0.3 |
| Toluene | 40.0 |
| Total | 50.3 |

Manufacture of Ink Ribbon 6

Ink ribbon 6 was obtained in the same manner as that for ink ribbon 1 except the following coating liquid was used to form a 1.5 μm-thick ink layer.

Coating liquid for ink layer

| Component | Parts by weight |
|---|---|
| Ethylene/vinyl acetate copolymer | 5.0 |
| Terpene phenol resin (melting point: 120° C.) | 2.0 |

-continued

| Coating liquid for ink layer | |
|---|---|
| Component | Parts by weight |
| Phthalocyanine Blue | 3.0 |
| Dispersant | 0.3 |
| Toluene | 40.0 |
| Total | 50.3 |

With respect to each of the obtained ink ribbons 1 to 6, the optical reflection density values of the respective Y, M, and C components were measured. The results are shown in Table 2.

TABLE 2

| | Optical reflection density | | |
|---|---|---|---|
| | Y component | M component | C component |
| Ribbon 1 | 1.21 | 0.33 | 1.53 |
| Ribbon 2 | 0.44 | 0.99 | 1.76 |
| Ribbon 3 | 1.51 | 1.59 | 0.04 |
| Ribbon 4 | 1.84 | 0.07 | 0.05 |
| Ribbon 5 | 0.47 | 1.61 | 0.08 |
| Ribbon 6 | 0.30 | 0.55 | 1.77 |

Evaluation Method

The image data of a full-color evaluation pattern (a fruit basket, ISO/DIS 12640 registered data) was subjected to a color separation processing into red, green, and blue. According to the correlation shown in Table 1, the image data was selected (two among red, green, and blue were selected) based on the values of Y, M, C components of the optical reflection density of the ink ribbons A, B selected from the ink ribbons 1 to 6 shown in Table 2. An image was formed under the following printing conditions by combining the selected image data and the combination of the ink ribbons A, B. The obtained image was observed visually and the natural degrees of colors were evaluated according to the following criteria. The results are shown in Table 3.

Printing conditions:

Printer: a thermal printer (a testing apparatus)

Print head: 600 dots per inch (edge distance: 100 $\mu$m)

Printing speed: 24.5 cm/sec

Receptor: Super Mat Art paper (manufactured by Mitsubishi Paper Mills, Ltd.)

Evaluation criteria:

○: Approximately natural colors are reproduced.

Δ: Natural expression to a certain extent is obtained.

X: An image with almost a single color is obtained.

TABLE 3

| Combination of ink ribbons | | Ink ribbon A | | | Ink ribbon B | | | Sum | | | |
|---|---|---|---|---|---|---|---|---|---|---|---|
| A | B | Y component | M component | C component | Y component | M component | C component | Y component | M component | C component | Evaluation |
| 1 | 2 | 1.21 | 0.33 | 1.53 | 0.44 | 0.99 | 1.76 | 1.65 | 1.32 | 3.29 | Δ |
| 1 | 3 | 1.21 | 0.33 | 1.53 | 1.51 | 1.59 | 0.04 | 2.72 | 1.92 | 1.57 | ○ |
| 1 | 4 | 1.21 | 0.33 | 1.53 | 1.84 | 0.07 | 0.05 | 3.05 | 0.4 | 1.58 | X |
| 1 | 5 | 1.21 | 0.33 | 1.53 | 0.47 | 1.61 | 0.08 | 1.68 | 1.94 | 1.61 | ○ |
| 1 | 6 | 1.21 | 0.33 | 1.53 | 0.3 | 0.55 | 1.77 | 1.51 | 0.88 | 3.3 | X |
| 2 | 3 | 0.44 | 0.99 | 1.76 | 1.51 | 1.59 | 0.04 | 1.95 | 2.58 | 1.8 | ○ |
| 2 | 4 | 0.44 | 0.99 | 1.76 | 1.84 | 0.07 | 0.05 | 2.28 | 1.06 | 1.81 | Δ |
| 2 | 5 | 0.44 | 0.99 | 1.76 | 0.47 | 1.61 | 0.08 | 0.91 | 2.6 | 1.84 | X |
| 2 | 6 | 0.44 | 0.99 | 1.76 | 0.3 | 0.55 | 1.77 | 0.74 | 1.54 | 3.53 | X |
| 3 | 4 | 1.51 | 1.59 | 0.04 | 1.84 | 0.07 | 0.05 | 3.35 | 1.66 | 0.09 | X |
| 3 | 5 | 1.51 | 1.59 | 0.04 | 0.47 | 1.61 | 0.08 | 1.98 | 3.2 | 0.12 | X |
| 3 | 6 | 1.51 | 1.59 | 0.04 | 0.3 | 0.55 | 1.77 | 1.81 | 2.14 | 1.81 | ○ |
| 4 | 5 | 1.84 | 0.07 | 0.05 | 0.47 | 1.61 | 0.08 | 2.31 | 1.68 | 0.13 | X |
| 4 | 6 | 1.84 | 0.07 | 0.05 | 0.3 | 0.55 | 1.77 | 2.14 | 0.62 | 1.82 | X |
| 5 | 6 | 0.47 | 1.61 | 0.08 | 0.3 | 0.55 | 1.77 | 0.77 | 2.16 | 1.85 | X |

As shown in Table 3, when the sum of the respective optical reflection density values for each color component obtained by color separation of the respective optical reflection density of two color thermal transfer ink ribbons into Y component, M component and C component were 1.0 or higher, an image with colors close to a full-color original image could be obtained.

In addition to the materials and ingredients used in the Examples, other materials and ingredients can be used in Examples as set forth in the specification to obtain substantially the same results.

Pseudo-full-color expression can be performed easily by thermal transfer using two color ink ribbons to save time and cost.

What is claimed is:

1. A method for forming an image by thermal transfer:

comprising forming a multi-color image using two chromatic color thermal transfer ink ribbons A and B, the thermal transfer ink ribbons A and B having respective chromatic colors which satisfy the following relations:

$$Y_A+Y_B \geqq 1.0$$

$$M_A+M_B \geqq 1.0$$

$$C_A+C_B \geqq 1.0$$

wherein $Y_A$, $M_A$, and $C_A$ are defined respectively as values obtained by color separation of the optical reflection density of the thermal transfer ink ribbon A into Y, M, and C components, and $Y_B$, $M_B$, and $C_B$ are defined respectively as values obtained by color separation of the optical reflection density of the thermal transfer ink ribbon B into Y, M, and C components.

2. The method for forming an image by thermal transfer according to claim 1, wherein at least one among the optical reflection density values $Y_A$, $M_A$, and $C_A$ is 0.9 or lower, and at least one among the optical reflection density values $Y_B$, $M_B$, and $C_B$ is 0.9 or lower.

* * * * *